US007293371B2

(12) United States Patent
Aveni

(10) Patent No.: US 7,293,371 B2
(45) Date of Patent: Nov. 13, 2007

(54) WOVEN SHOE WITH INTEGRAL LACE LOOPS

(75) Inventor: Michael A. Aveni, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 225 days.

(21) Appl. No.: 10/945,867

(22) Filed: Sep. 22, 2004

(65) Prior Publication Data

US 2006/0059715 A1 Mar. 23, 2006

(51) Int. Cl.
*A43B 23/00* (2006.01)
*A43C 11/00* (2006.01)

(52) U.S. Cl. ..... 36/45; 36/50.1; 36/88

(58) Field of Classification Search ..... 36/45, 36/50.1, 88, 91

See application file for complete search history.

(56) References Cited

U.S. PATENT DOCUMENTS

| | | | | | |
|---|---|---|---|---|---|
| 586,137 | A * | 7/1897 | Medger | 36/3 R |
| 621,922 | A * | 3/1899 | Kelsall | 36/3 A |
| 1,540,903 | A * | 6/1925 | Santoyo | 36/3 A |
| 1,663,319 | A * | 3/1928 | Snell | 36/3 A |
| 1,773,681 | A * | 8/1930 | Johnson | 36/45 |
| 2,205,963 | A * | 6/1940 | Stritter | 36/3 A |
| 3,497,971 | A * | 3/1970 | Hayashi | 36/9 R |
| 5,291,671 | A * | 3/1994 | Caberlotto et al. | 36/88 |
| 5,371,957 | A * | 12/1994 | Gaudio | 36/50.1 |
| 5,430,959 | A * | 7/1995 | Mitsui | 36/88 |
| 5,497,564 | A * | 3/1996 | Allen et al. | 36/50.1 |
| 6,108,943 | A * | 8/2000 | Hudson et al. | 36/102 |
| 6,128,835 | A * | 10/2000 | Ritter et al. | 36/45 |
| 6,367,169 | B1 * | 4/2002 | Barret | 36/51 |
| 6,772,541 | B1 * | 8/2004 | Ritter et al. | 36/88 |
| 6,925,734 | B1 * | 8/2005 | Schaeffer | 36/50.1 |
| 2002/0148142 | A1 * | 10/2002 | Oorei et al. | 36/129 |
| 2004/0205982 | A1 * | 10/2004 | Challe | 36/55 |

* cited by examiner

*Primary Examiner*—Marie D Patterson
(74) *Attorney, Agent, or Firm*—Banner & Witcoff, Ltd

(57) ABSTRACT

An article of footwear includes a woven region. A fit adjustment system includes a lace strap superimposed with strands of material forming the woven region. The lace strap is routed around the shoe and forms opposing pairs of lace holding elements such as lace loops. More specifically, the lace strap extends downwardly from a lace holding element on a first side of the upper, across and underneath the footbed, around the heel region, back across and underneath the footbed, and upwardly to form a lace holding element on the second side. By the routing of the lace strap, the lace strap is integrated with the heel and arch portions of the shoe. A shoe lace is routed through the lace holding elements and may be adjusted to affect the fit of the upper to a foot of a user.

17 Claims, 13 Drawing Sheets

WOVEN SHOE WITH INTEGRAL LACE LOOPS

BACKGROUND OF THE INVENTION

This invention relates to an article of footwear having a woven region. More specifically, the invention relates to an article of footwear having an integrated woven region and lacing system.

DESCRIPTION OF BACKGROUND ART

Most footwear products have two general parts: an upper and a sole. The upper is commonly designed to comfortably enclose the foot and the sole is commonly intended to provide traction and support. The upper on some footwear designs have included woven regions. For example, woven leather straps have been included on many dress and casual shoes. The ends of the woven leather straps are typically fixedly affixed to the sole or elsewhere on the upper.

In an existing design, the Air Woven made by NIKE®, includes woven stretch webbing material. In this model, the fit of the shoe to the wearer is dictated by the slack on the straps relative to the size of the foot of the user, and the stretch of the material.

In another existing shoe model, the Air Presto Woven by NIKE®, woven stretch mesh material is used in the forefoot region and extends from a tongue-shaped region of expandable material to the sole. A lacing system, separate from the woven region, is comprised of joined plastic elements connected to the sole. The plastic elements include integrally molded holes functioning as false eyelets on opposing sides of the shoe. A shoe lace is routed through the false eyelets in a cross-over fashion and the opposing ends of the lace may be tied to achieve a desired tension.

However, woven shoes have failed to progress substantially beyond these models. Accordingly, an improved woven shoe design was thus needed.

BRIEF SUMMARY OF THE INVENTION

The following presents a simplified summary of the invention in order to provide a better understanding of some aspects of the invention. It is not intended to be an extensive overview of the invention or aspects thereof. Nor is it intended to identify or define critical elements of the invention. This summary merely describes some aspects of the invention in a simplified manner as a prelude to the detailed description hereinafter.

It is an aspect of the invention to provide an article of footwear having an upper with a woven area having a weave. A strap is incorporated into the weave of the woven area, and is configured to permit the adjustment of the fit of the upper to a foot of a user.

It is yet another aspect, the article of footwear includes an upper having medial and lateral sides, and a fit adjusting system. The fit adjusting system is configured to provide an adjustable fit to the upper. The fit adjusting system including a lateral side lace holding element and a medial side lace holding element being formed from a common elongated strand member. The elongated strand member extends below the footbed.

Another aspect of the present invention is directed to an article of footwear including an upper having lateral and medial portions, a lower portion configured to extend beneath the foot of the user; and a fit adjustment system. The fit adjustment system includes a strap and is configured to provide an adjustable fit to the upper. The strap has first and second opposing ends that are each attached to the lower portion.

The various advantages and features of novelty that characterize the present invention are pointed out with particularity in the claims. To gain an improved understanding of the advantages and features of novelty that characterize the present invention, however, reference should be made to the enclosed detailed description and accompanying drawings which describe and illustrate various embodiments of the invention.

DETAILED DESCRIPTION OF THE INVENTION

In the following description of the various embodiments, reference is made to the accompanying drawings that depict illustrative arrangements in which the invention may be practiced. It is understood that other embodiments may be utilized and modifications may be made without departing from the scope of the present invention. Additionally, various terms used herein are defined below.

As used herein, the term "weave" is recognized to mean one or more elongated elements with portions interlaced or otherwise united by close connection to suggest a woven appearance. Examples of weaves include, but are not limited to, a plain weave, a plain weave oriented diagonally to form a diagonal weave, a basket weave, a ribbed weave, a twill weave, a herringbone weave, a satin weave, a pile weave, a swivel weave, a dobby weave, and a slub duck weave.

As used herein, the term "fit adjusting lace" is defined as a lacing element configured and positioned with respect to the upper of a shoe such that the lace may be tightened or loosened to tighten or loosen, respectively, the fit of the upper to the user's foot.

Figure 9:
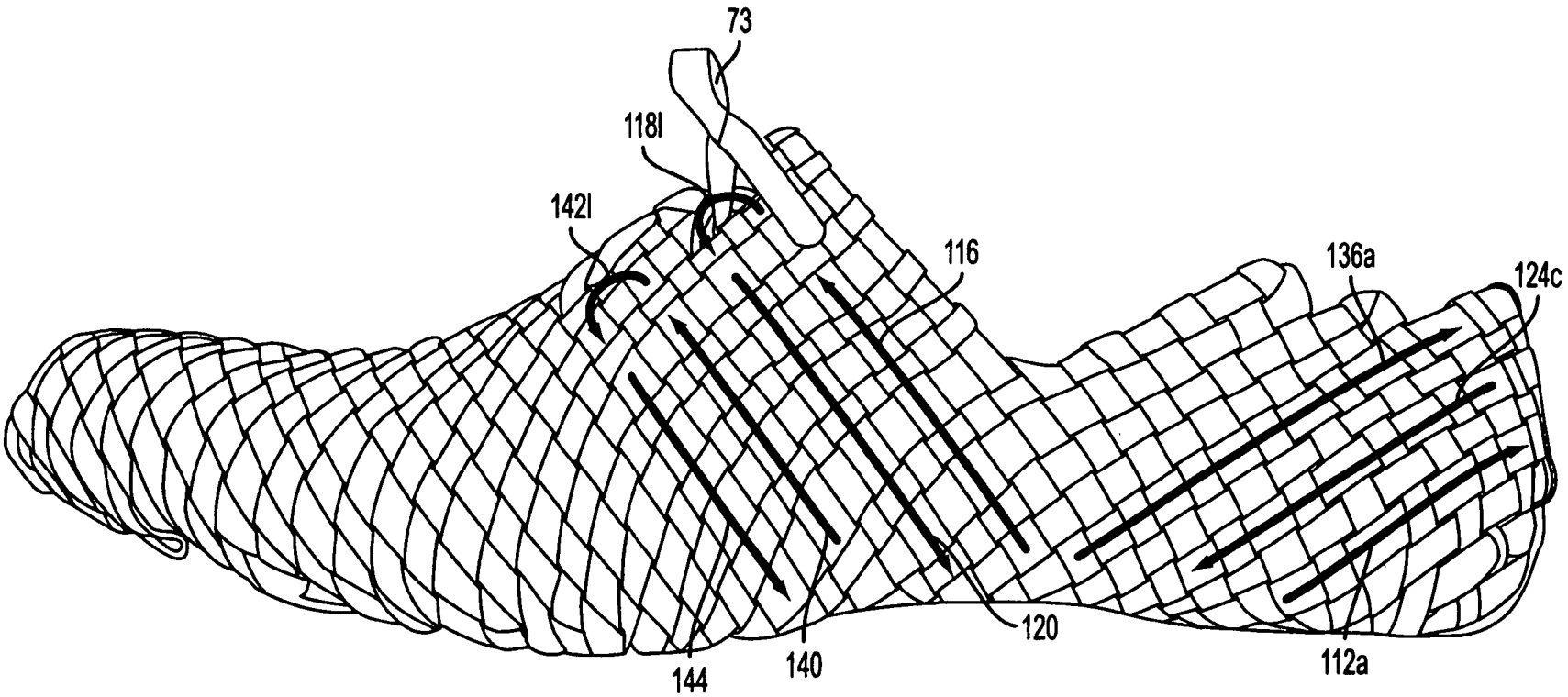
FIG. 9 is a lateral side view of the article of footwear illustrating a routing path of a strap member into the upper.
Figure 10:
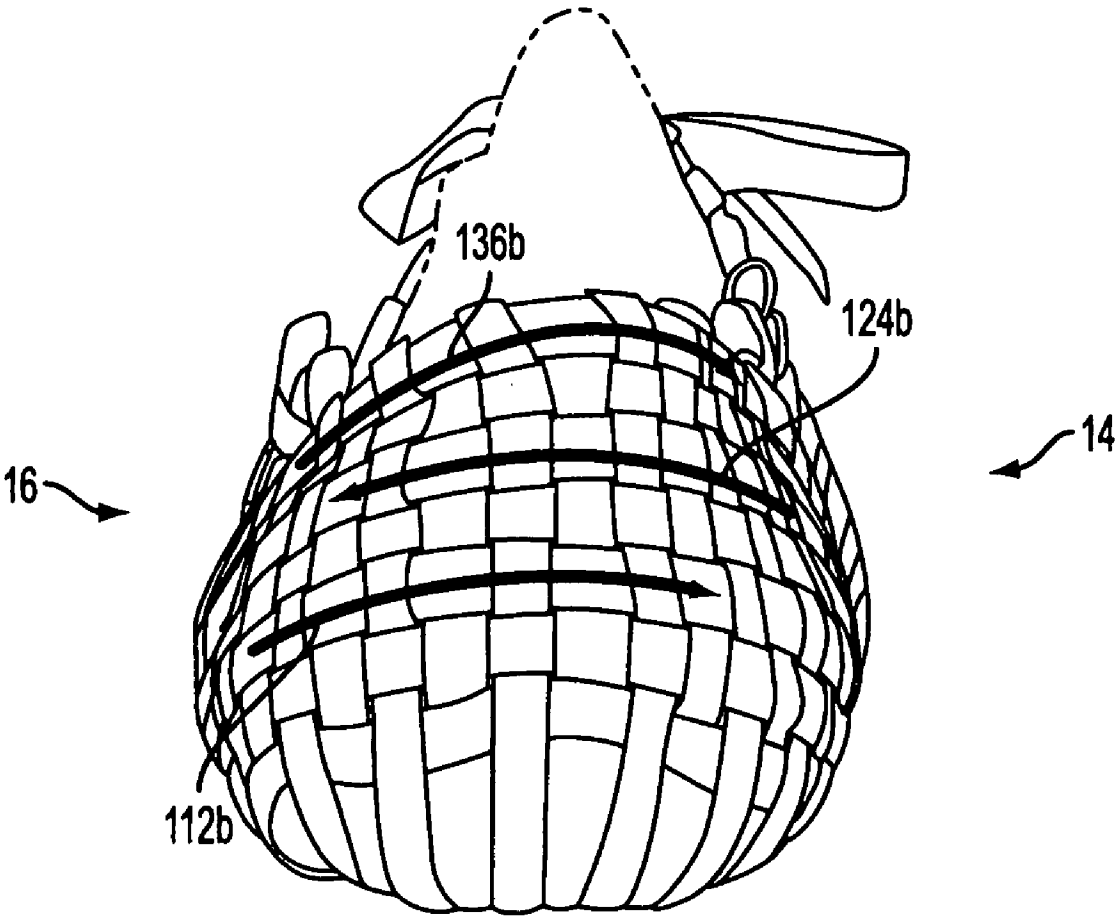
FIG. 10 is a rear view of the article of footwear illustrating a routing path of a strap member into the upper.
Figure 11:
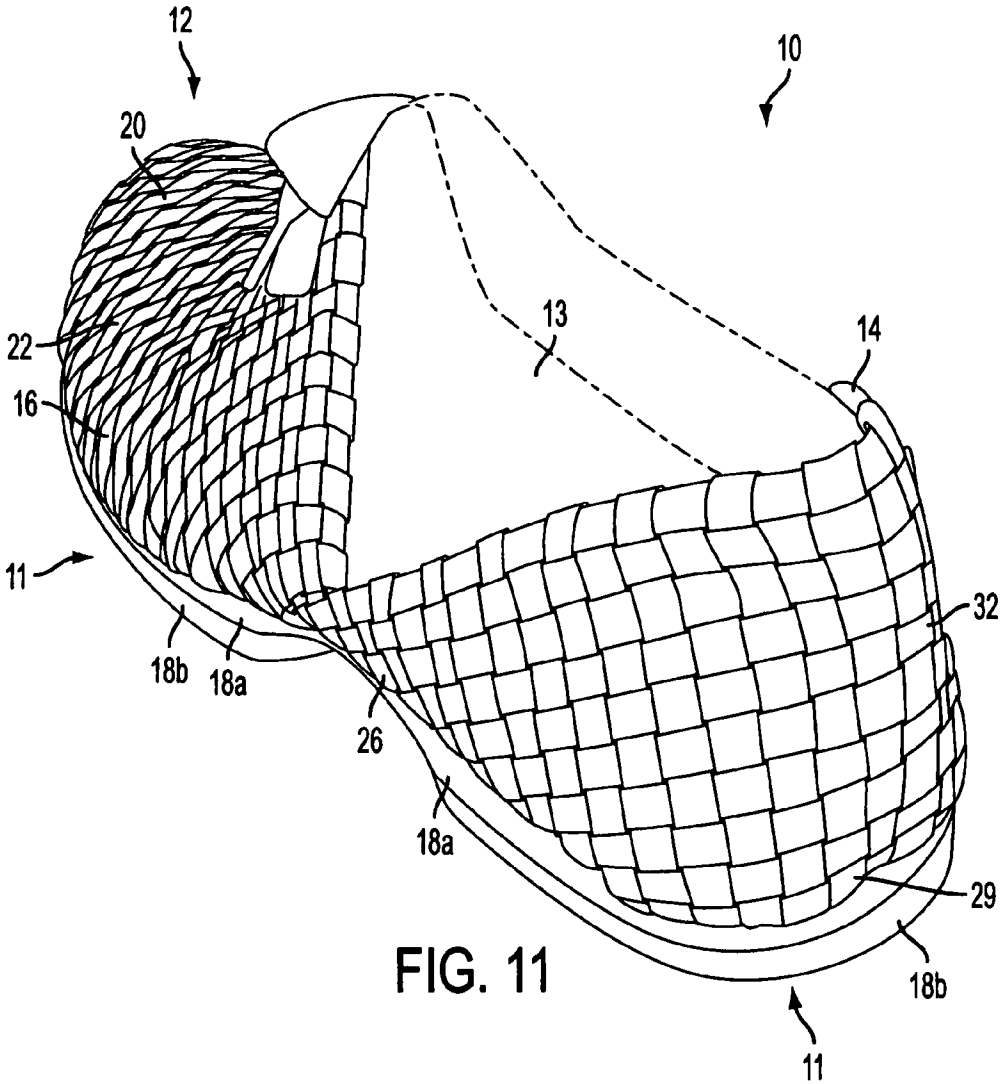
FIG. 11 is a perspective view of the article of footwear shown in FIG. 1 pictured with a sole unit thereon.

FIGS. 1-13 show an illustrative embodiment of an improved article of footwear generally designated with reference number 10 and referred to herein as a shoe. More specifically, FIG. 11 shows an assembled shoe 10 where an upper 12 is attached to a sole 11. The sole 11 is intended to provide a wear resistant lower surface and cushioning capabilities. The upper 12 holds the user's foot to the sole 11 and provides a fit for the user's foot. The upper 12 includes a foot opening 13 therein permitting the insertion of the user's foot into the upper 12. FIGS. 1-10 illustrate the portion of the shoe, specifically the portion forming the upper 12, in a state prior to attachment to a sole 11.

The upper 12 includes a medial side 14 and a lateral side 16. The medial side 14 is the side that faces toward the centerline of the user's body when worn. The lateral side 16 is the side that faces away from the centerline of the user's body when worn. The upper 12 can also be described as having other defined regions including a toe box region 20, a forefoot region 22, an arch region 26, a top foot instep region 24, and a heel region 28 having a heel corner 29, with the meaning of these terms generally recognized in the art except as described below. The top foot instep region 24 is used herein to refer to the part of the shoe that normally overlies the top of the foot in the instep region between the front of the foot opening 13 and the toe box region 20. The heel corner 29 represents a location in the heel region 28 that corresponds to the rearmost location on the footbed adjacent the inside of the upper 12, which is generally where the bottom-back of the user's heel would be located if the shoe was properly sized for that user.

In an illustrative embodiment, the upper 12 includes a woven body 32 that covers the majority of the upper 12 and/or the major portions of the arch, heel and instep regions 26, 28 and 24, respectively. However, the upper 12 may be formed by more than one woven region in lieu of a primary single woven body. In the depicted illustrative embodiment of a woven body 32, over 90% of the surface area of the upper 12 is covered by the weave. However, more preferably as depicted, the weave forms over 95% of the upper and more preferably the upper consists of or substantially consists of the weave.

The weaving material 34 preferably has a width between 3.0 mm and 10.0 mm forming the face of the weave. More specifically, the weaving material 34 preferably has a width between 4.0 mm and 7.0 mm forming the face of the weave. In one arrangement, the weaving material 34 is 6.0 mm wide forming the face of the weave and 1.0 mm thick. The lace strap 82, as described hereinafter, preferably is sized substantially the same or slightly smaller than the width of the weaving material 34 and illustrative width sizes for the lace strap 82 therefore correspond to those of the weaving material 34. As used herein, the term "coarse weave" is herein defined as a weave wherein the weave is formed from woven elements having a width greater than 3.0 mm wide forming the face of the weave.

The woven region or regions forming woven body 32 is preferably formed of strands of interwoven weaving material, e.g., material strand sections or webbing elements 34. In the depicted embodiment, the woven body 32 is formed by a standard cross-over weave pattern. However, alternate weaving styles such as a diagonal weave, a basket weave, a ribbed weave, a twill weave, a herringbone weave, a satin weave, a pile weave, a swivel weave, a dobby weave, and a slub duck weave may be used in lieu of a cross-over weave.

Preferably, the woven body 32 is formed from weaving any desirable number of elongated strand elements 34 into the desired shape, size and pattern. One illustrative number of elongated strand elements 34 to use would be two. However, in another embodiment, not shown, a single elongated strand is used to create the woven body 32. More than two strands may also be used. In the assembly process, the woven material may be coupled to a lasting sock 35 as a base and the strands may be woven into holes in the sock 35. In lieu of lasting sock 35, string lasting (not shown) may be used. In such an arrangement, a cord is used to weave around and is subsequently pulled tight to hold the weave together. It is tied off after the weave is completed to finish the weaving process. Further, or alternatively, a void created in the heel and forefoot is suitable for a midsole or outsole to extend through either from the inside or outside of the woven upper.

Numerous different materials may be used for the weaving material 34. Based on the desired arrangement, the weaving material 34 can be made from a material with elastic properties or from materials that are substantially inelastic. If an elastic property is desired in the strands of weaving material to provide some amount of stretch for added comfort, preferably a rubberized membrane or polypropylene is used. If strands of weaving material with inelastic properties are desired, preferably leather, nylon webbing, or other synthetic webbing is used. In another arrangement, a semi-stretch material such as a shoelace in lieu of a stretch or non-stretch material may be used. This semi-stretch characteristic allows the weaving to hold its shape and offer support without restricting movement. The semi-stretch material exhibits stretching properties that are typically in between those of stretch and non-stretch materials and can be used in woven shoes. In another arrangement, the woven strands include strands of elastic weaving material and inelastic weaving material.

If more than one strand of weaving material 34 is used and based on the details of the weave pattern, the strands may be preferably connected prior to being woven. In such an event, the ends of strands of weaving material are preferably knotted together or attached with any suitable adhesive material. Other known methods of attaching the strands of weaving material include physical attachment with any of variety of adhesives, physical attachment with any of variety of mechanical attaching components such as tacks, nails, bards and other similar devices, physical attachment via manipulation of the physical properties of the weaving material by heat, cold, radiation, and/or exposure to different wavelengths of light and/or sound, or combinations of any of the above. In another arrangement, the ends of the strands are woven together as a connection device. To accomplish this, an extra layer of weaving at the connection point is performed, and such avoids the need for an adhesive.

Figure 5:
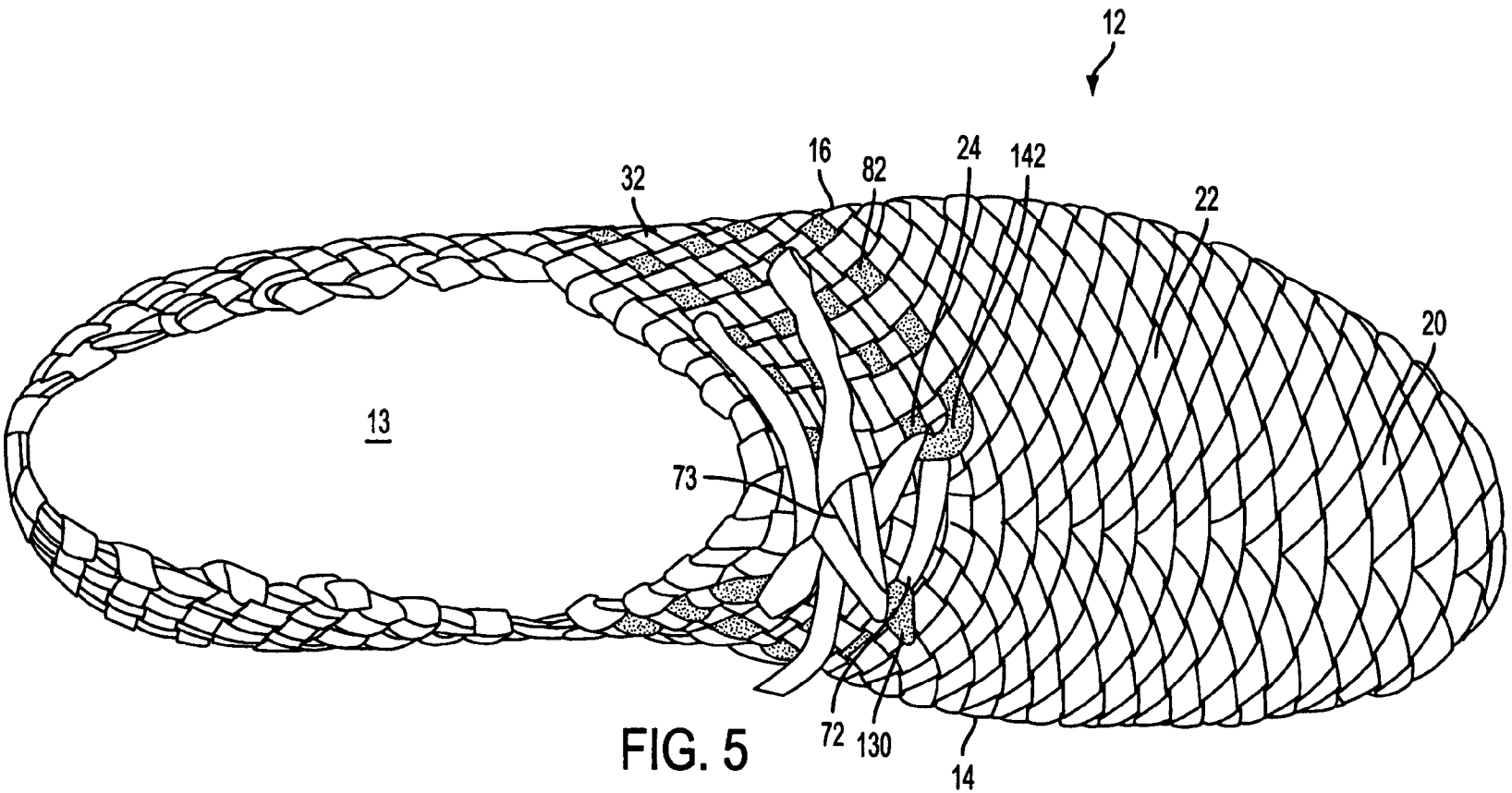
FIG. 5 is a top view of the article of footwear shown in FIG. 1.
Figure 6:
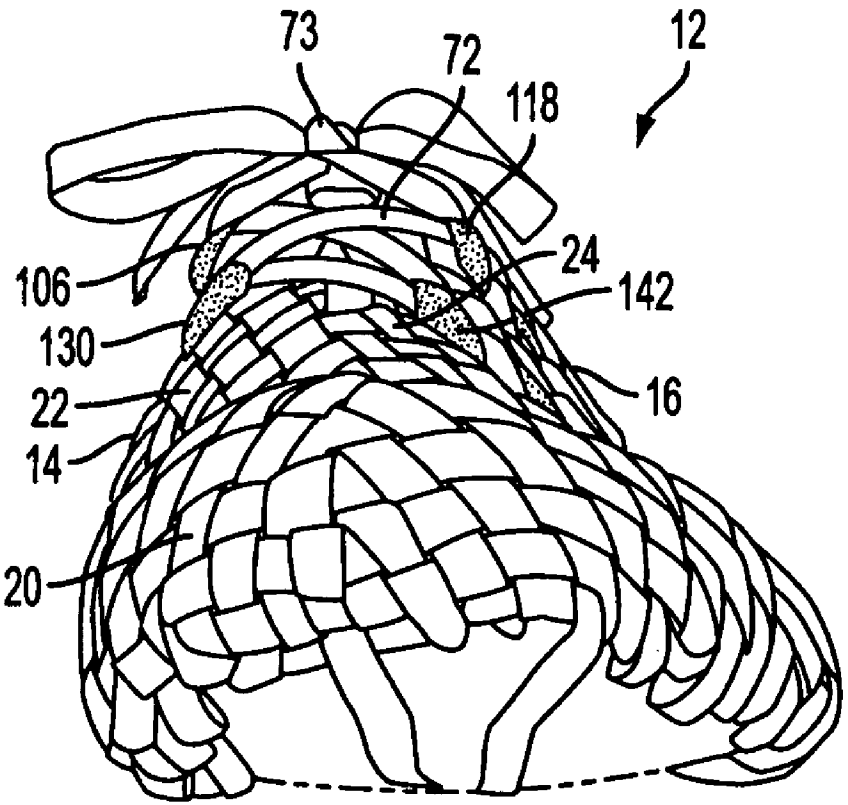
FIG. 6 is a front view of the article of footwear shown in FIG. 1.

The shoe 10 includes a fit adjusting system that includes a lace strap 82 with part of the lace strap 82 forming lace holding elements/lace loops 106, 118, 130, and 142, and a fit adjusting lace, e.g., a shoe lace 72. As seen in FIGS. 5 and 6, the illustrative embodiment includes two spaced sets of lace loops located in the top foot instep region 24, with two lace loops 106, 130 and 118, 142 in each set. However, it is recognized that more or less lace loops could be used and the configuration of the lace loops need not be as depicted in the figures.

Functionally, the lace strap 82 wraps around regions of the shoe, and when the shoe lace 72 is cinched, the lace loops 106, 118, 130, and 142 are pulled closer together, which in turn, tightens the fit of the shoe 10 to the foot of the user. As the lace strap 82 is preferably coupled in the arch and heel regions, this effectively tightens the shoe to the foot of the user in the arch and heel regions. The lace strap 82 is preferably made from a semi-stretch material, e.g., but the lace strap may be provided with a higher or smaller amount of stretch as desired.

In the depicted embodiment, the elongated lace strap 82 forms four lace loops 106, 118, 130, and 142. These laces loops are preferably positioned at the top foot instep region 24 and medial-to-laterally spaced apart. Specially, as depicted, there are two medial lace loops—upper medial lace loop 106 and lower medial lace loop 130, and two lateral lace loops—upper lateral lace loop 118 and lower lateral lace loop 142. This arrangement enables the fit of the shoe 10 to be tightened when the spaced lace loops are closer and can be loosened when the spaced lace loops are farther apart. In the illustrative embodiment, the spaced apart lace loop pairs are centrally located on approximately the longitudinal axis of the shoe 10. However, the spaced apart lace loop pairs may be offset if desired in a manner common as to the eyelet pairs on existing soccer shoes.

The elongated lace strap 82 is preferably incorporated into the body of the shoe upper 12 on the medial 14 and lateral 16 sides in the midfoot region by at least one coupling point per lace loop, more preferably at least two coupling points per lace loop, and even more preferably three or four coupling points per lace loop. The elongated lace strap 82 is also coupled to the upper 12 in the heel region 28 and the arch region 26 of the shoe 10, and as described hereinafter, encircles the heel corner region 29 of the shoe, and extends under and crosses beneath the foot to provide support in the arch region. In these regions 26 and 28, the elongated strap element 82 is preferably coupled to the shoe 10 at least one time per lace loop pair, more preferably at least two times per lace loop pair, and even more preferably at least four times per lace loop pair. The formation of the upper as a woven body 32 or a substantially woven body 32 enables a high number of coupling points between the strap element 82 and the upper 12 without the need for extra strap holding elements and provides a good integration between the strap element 82 and the upper 12. Further, the strap element 82 may be superimposed over a woven strand in the woven body 32 for a portion of the weave; therefore, it is recognized that the weave may be in part formed by the strap element 82.

Figure 7:
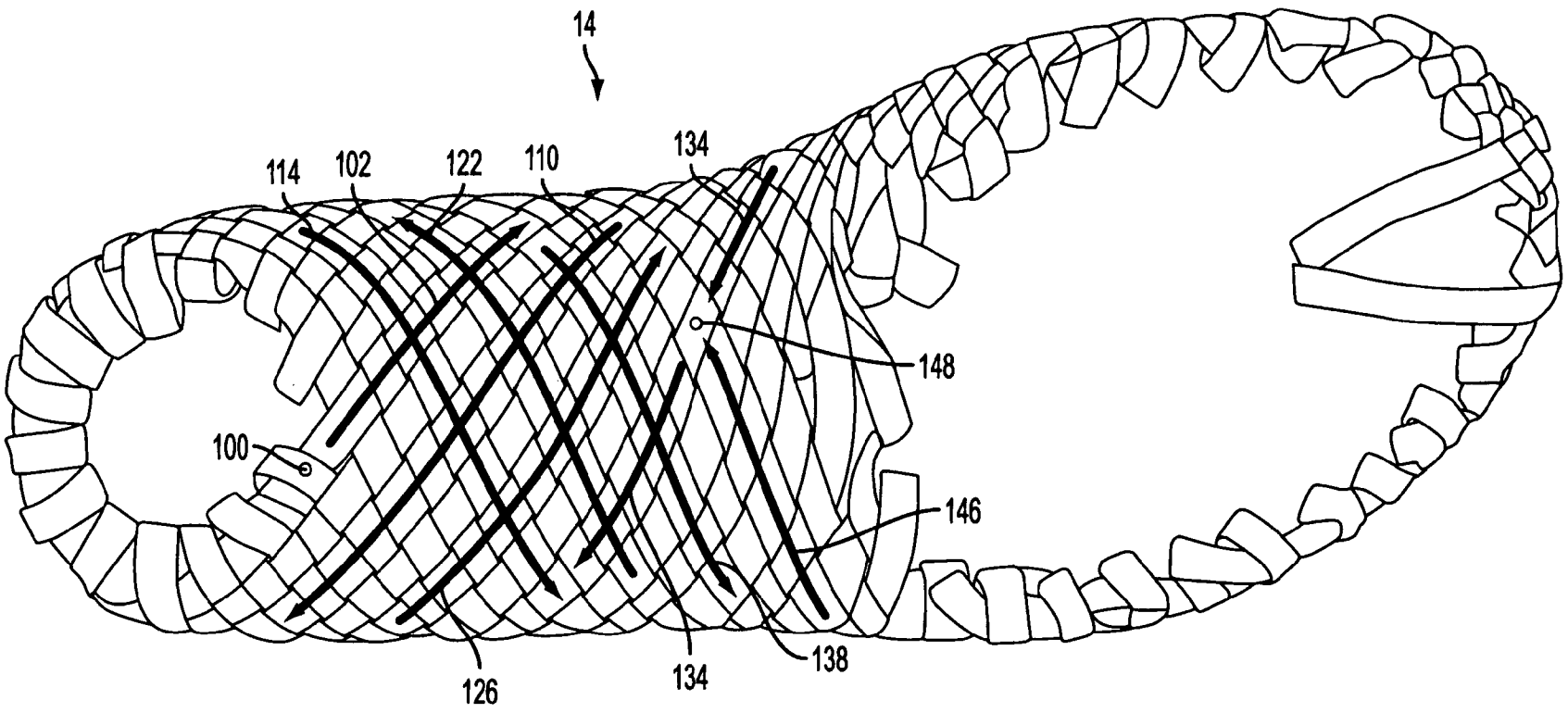
FIG. 7 is a bottom view of the article of footwear illustrating a routing path of a strap member into the upper.
Figure 8:
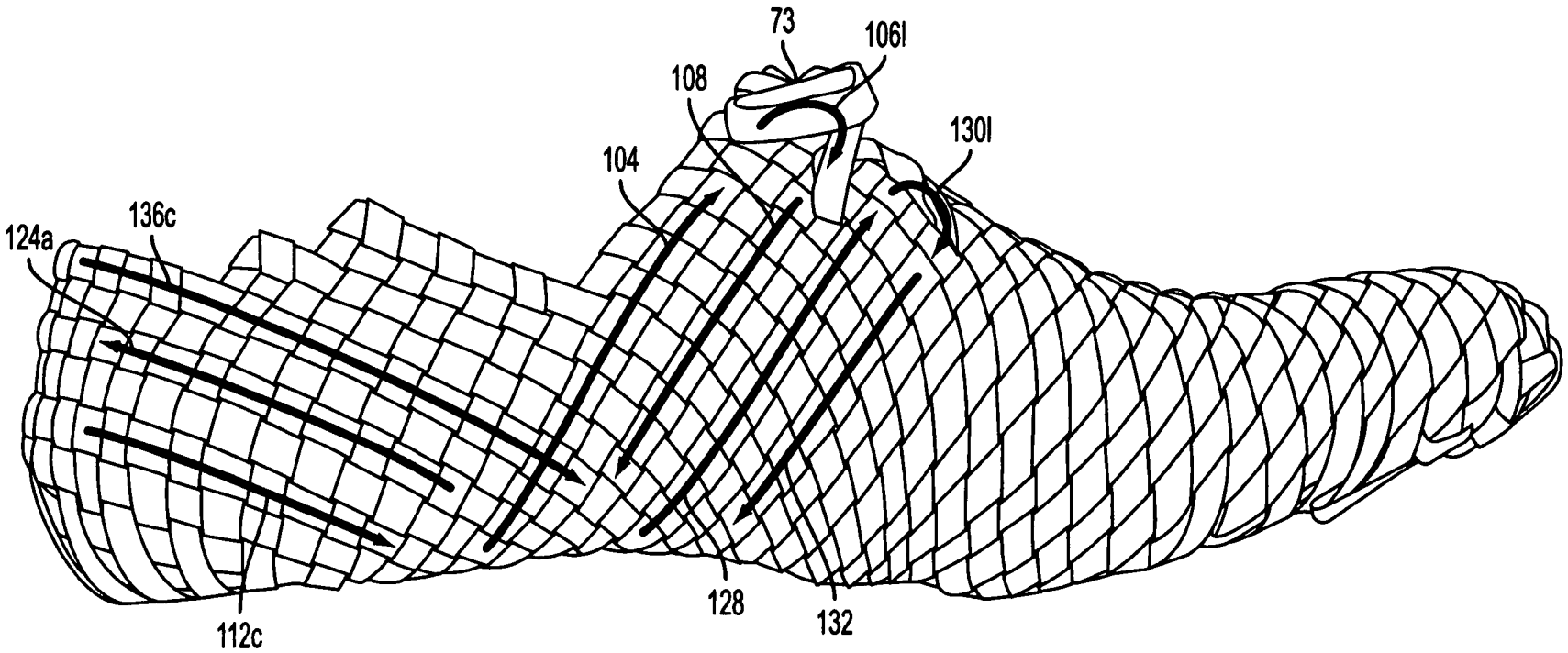
FIG. 8 is a medial side view of the article of footwear illustrating a routing path of a strap member into the upper.

In a first arrangement as depicted, the lace strap 82 in interjected into the weave such that it directly superimposes strand portions of the material forming the weave. An exemplary routing path of the elongated strap element 82 is described in conjunction with FIGS. 7-10. The strap element 82 has opposing ends 100 and 148 which are respectfully designated as starting end 100 and finishing end 148 for ease of explanation of the routing of strap element 82. The opposing ends are preferably attached to shoe 10 in any desirable location and technique. FIG. 7 shows the starting end 100 of strap element 82 on the bottom of the body 32 in the rearfoot region the staring end 100 may be affixed to the weave by a desirable technique such as adhesive or a mechanical device. From that point 100 and until finishing point 148, it is integrated into the weave of the body 32 and is adjustably movable relative to weave initially extends forward to medial arch as designated by arrow 102. As seen in FIG. 8, the strap 82 continues, as denoted by arrow 104, upwardly and forward from medial arch region towards the upper medial lace loop 106 at the top of the top foot instep region. The strap element 82 then extends out of the weave, includes a bend of substantially 180° and is returned into the weave in the direction of arrow 1061 to form upper medial lace loop 106. The elongated strap 82 is then routed downwardly and rearwardly from upper medial lace loop 106 at the top of the top foot instep region to the medial arch region as denoted by arrow 108.

The strap 82 continues across the bottom of the shoe from the medial arch rearward toward the heel region on the lateral side as illustrated by arrow 110. The strap 82 extends around the rear of the heel region 28 from the lateral side 16 to the medial side 14. This is evident from FIGS. 8-10 and arrows 112*a*, 112*b*, and 112*c*. Specifically, arrow 112*a* in FIG. 9 illustrates the routing of the strap from the lateral midfoot region upwardly and rearwardly to the rear of the shoe. FIG. 10 depicts arrow 112*b* showing the routing from the lateral 16 side to the medial side 14 in the heel region. Arrow 112*c* in FIG. 8 illustrates the routing of the strap from the heel region downwardly and forwardly to medial arch region of the shoe.

As shown in FIG. 7, the strap 82 continues across the bottom of the shoe from the medial heel region forward toward the lateral arch region as illustrated by arrow 114. Arrow 116 in FIG. 9 shows the direction of the strap 82 as it extends upwardly and forwardly from the lateral arch region to the upper lateral lace loop 118 at the top of the top foot instep region 24. The strap element 82 then extends out of the weave, includes a bend of substantially 180° and is returned into the weave in the direction of arrow 1181 to form upper lateral lace loop 118. The elongated strap 82 is then routed downwardly and rearwardly from upper lateral lace loop 118 at the top of the top foot instep region to the lateral arch region as denoted by arrow 120.

The strap 82 continues across the bottom of the shoe from the lateral arch rearward toward the heel region on the medial side as illustrated by arrow 122. The strap 82 then extends around the rear of the heel region 28 from the medial side 14 to the lateral side 16. This is evident from FIGS. 8-10 and arrows 124*a*, 124*b*, and 124*c*. Specifically, arrow 124*a* in FIG. 8 illustrates the routing of the strap from the medial midfoot region upwardly and rearwardly to the rear of the shoe. FIG. 10 depicts arrow 124*b* showing the routing from the medial side 16 to the lateral side 14 in the heel region. Arrow 124*c* in FIG. 9 illustrates the routing of the strap from the heel region downwardly and forwardly to lateral arch region of the shoe.

As shown in FIG. 7, the strap 82 continues across the bottom of the shoe from the lateral heel region forward toward the medial arch region as illustrated by arrow 126. Arrow 128 in FIG. 8 shows the direction of the strap 82 as it extends upwardly and forwardly from the medial arch region to the lower medial lace loop 130 at the top foot instep region 24. The strap element 82 then extends out of the weave, includes a bend of substantially 180° and is returned into the weave in the direction of arrow 1301 to form lower medial lace loop 130. The elongated strap 82 is then routed downwardly and rearwardly from lower medial lace loop 130 at the top foot instep region to the medial arch region as denoted by arrow 132.

The strap 82 continues across the bottom of the shoe from the medial arch rearward toward the heel region on the lateral side as illustrated by arrows 134. The strap 82 extends around the rear of the heel region 28 from the lateral side 16 to the medial side 14. This is evident from FIGS. 8-10 and arrows 136*a*, 136*b*, and 136*c*. Specifically, arrow 136*a* in FIG. 9 illustrates the routing of the strap from the lateral midfoot region upwardly and rearwardly to the rear of the shoe. FIG. 10 depicts arrow 136*b* showing the routing from the lateral 16 side to the medial side 14 in the heel region.

Arrow 136*c* in FIG. 8 illustrates the routing of the strap from the heel region downwardly and forwardly to the medial arch region of the shoe.

As shown in FIG. 7, the strap 82 continues across the bottom of the shoe from the medial heel region forward toward the lateral arch region as illustrated by arrow 138. Arrow 140 in FIG. 9 shows the direction of the strap 82 as it extends upwardly and forwardly from the lateral arch region to the lower lateral lace loop 118 at the top foot instep region 24. The strap element 82 then extends out of the weave, includes a bend of substantially 180° in the direction of arrow 1421 and is returned into the weave to form upper lateral lace loop 142. The elongated strap 82 is then routed downwardly and rearwardly from lower lateral lace loop 142 at the top foot instep region to the lateral arch region as denoted by arrow 144.

The strap 82 continues across the bottom of the shoe from the lateral arch rearward in a medial direction toward a fixation point as illustrated by arrow 146. The fixation point is preferably at or immediately adjacent to the other or finishing end 148 of the strap 82. The finishing end 148 of the strap may be attached to another webbing element in the weave and or another location on the strap 82 and such may be accomplished by any suitable attachment technique such as by a suitable knot, stitching, an adhesive, or by a mechanical attachment element.

A fit adjusting lace such as shoe lace 72 is configured and positioned with respect to the upper of a shoe such that the lace may 72 be tightened or loosened to tighten or loosen, respectively, the fit of the upper to the user's foot. The shoe lace 72 is laced through lace loops 106, 118, 130, and 142 in a conventional crossing manner such that when the shoe lace 72 is cinched, the opposing pairs of lace loops 106 and 118, and 130 and 142 are pulled closer together, which in turn, tightens the fit of the shoe 10 to the foot of the user. The lace may be tied in a suitable bow or knot 73 to retain the desired level of fit. In the depicted illustrative embodiment, the lace 72 is directly coupled to/routed through the lace loops 106, 118, 130, and 142. However, if desired, lace 72 may be indirectly coupled to the lace loops 106, 118, 130, and 142 by an intermediate element such as by D-rings, lace hooks, etc. to obtain a similar effect.

In an illustrative embodiment, as depicted in FIG. 11, the sole 11 consists of a midsole 18*a* and an outsole 18*b*. The composition of midsole 18*a* may be of any desired structure or material, such as compression molded ethylene vinyl acetate (EVA), phylon, or polyurethane, intended to provide cushioning for the user. Many variations of midsole 18*a* structures that may be used in the present invention include but are not limited to full length molded designs and discrete portions of cushioning material. Further, if desired, the midsole 18*a* can include one or more subcomponents such as gas, liquid, or fluid bladders encapsulated in midsole material, and/or vertical column structures. The article of footwear 10 of the present invention is compatible with any known outsole 18*b*. The outsole 18*b* is formed of any conventional durable material to resist wearing during use, such as but not limited to, rubber and rubber compositions. An insole (not pictured) can be attached to the upper side of the midsole 18*a* to form a footbed. The insole is also preferably formed from any desirable material, and many conventional materials, such as an open cell polyurethane, or EVA, may be are used in the insole to provide support and comfort to the user's foot while wearing the shoe.

The upper 12 is preferably fixedly attached to the sole 11 and such may be accomplished in any desired manner, such as by stitching and/or a chemical adhesion bond (e.g., polyurethane or a cement) as is known in the art. In the embodiment having the weave as shown, the exposed perimeters of the weave on the bottom of upper would be attached to the sole 11, either separate rearfoot and forefoot sole portions or to corresponding regions in a full length sole, to help maintain the shape of the upper 12 formed by the weave, provide a high degree of flexibility, and provide a high degree of adjustability to lace strap 82.

Figure 1:
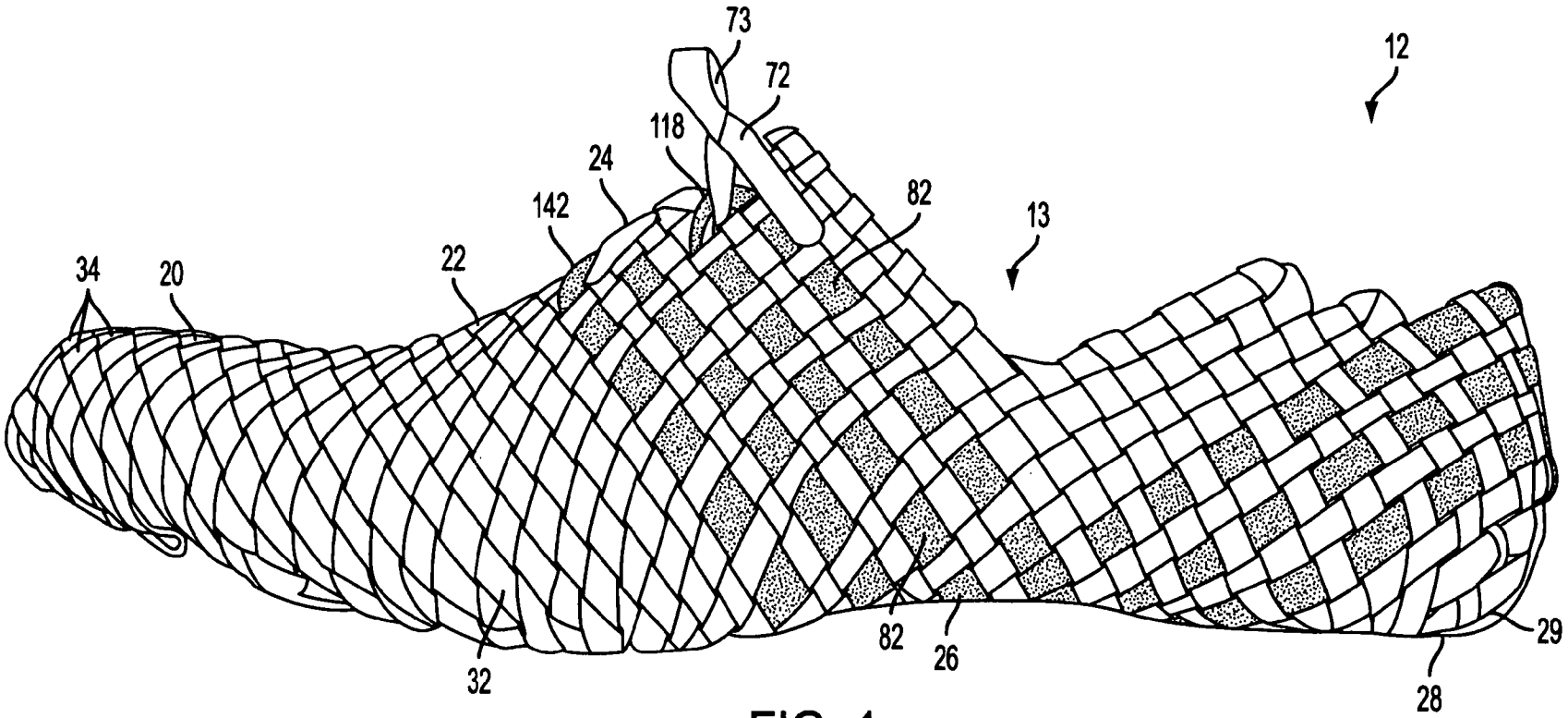
FIG. 1 is a lateral side view of an illustrative article of footwear, depicted without a sole and/or prior to attachment to a sole, in accordance with the present invention.
Figure 2:
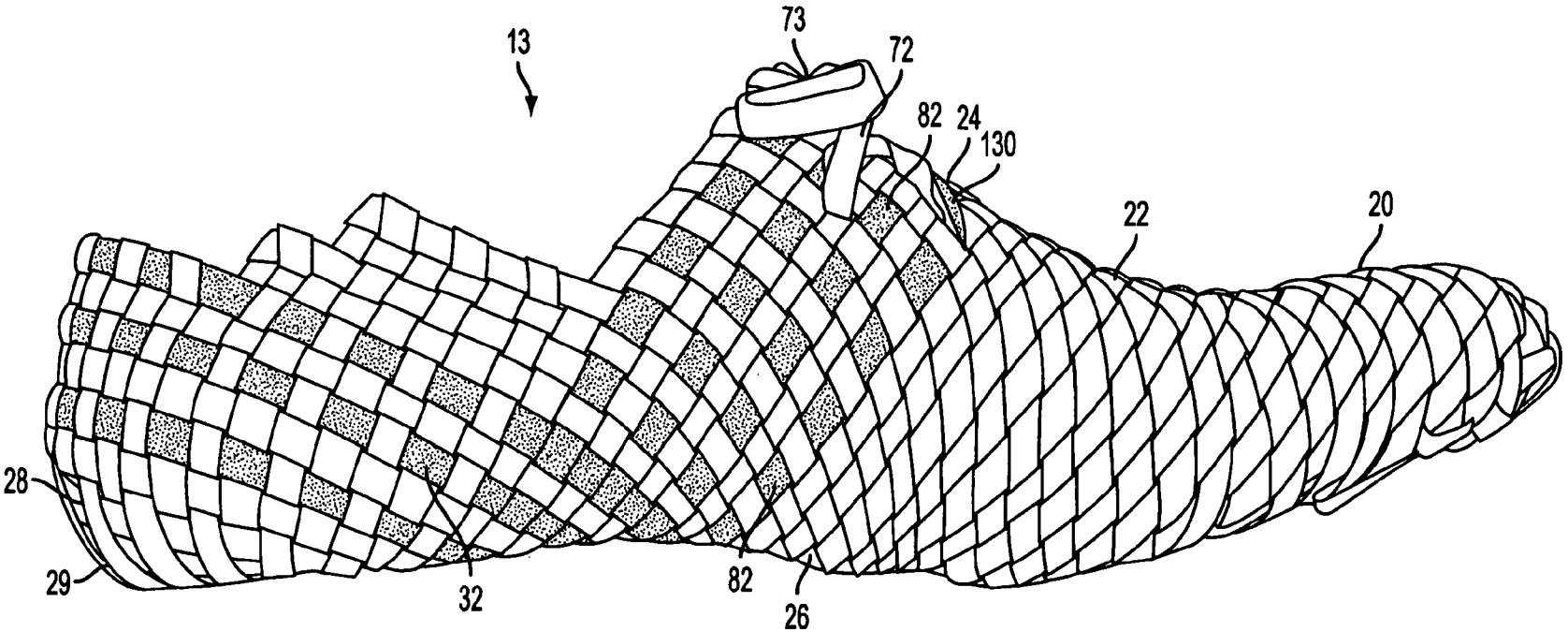
FIG. 2 is a medial side view of the article of footwear shown in FIG. 1.
Figure 3:
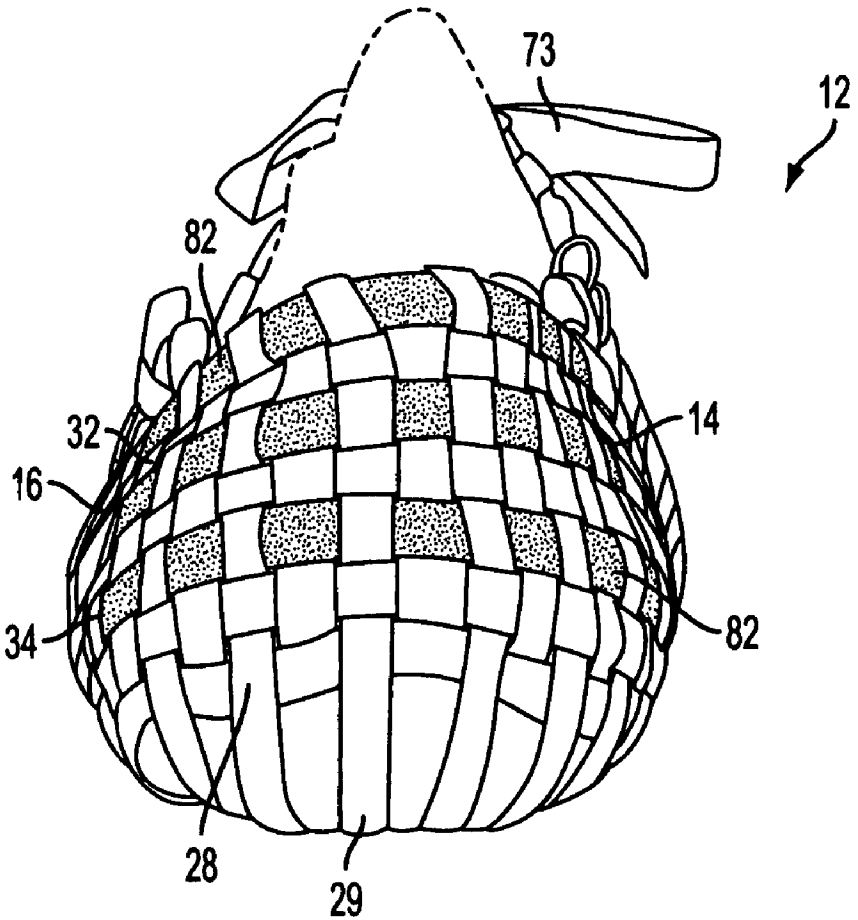
FIG. 3 is a rear view of the article of footwear shown in FIG. 1.
Figure 4:
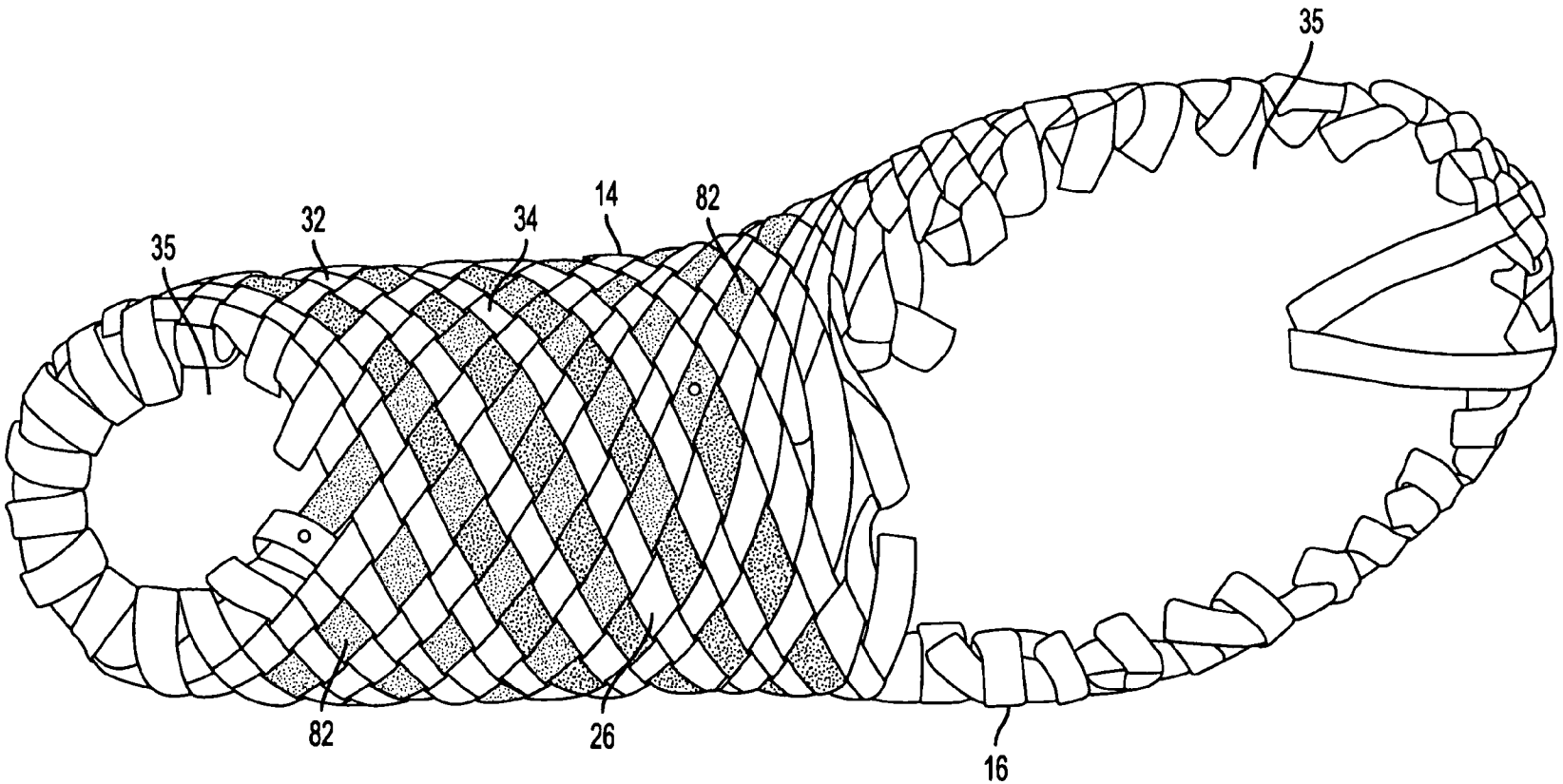
FIG. 4 is a bottom view of the article of footwear shown in FIG. 1.
Figure 12:
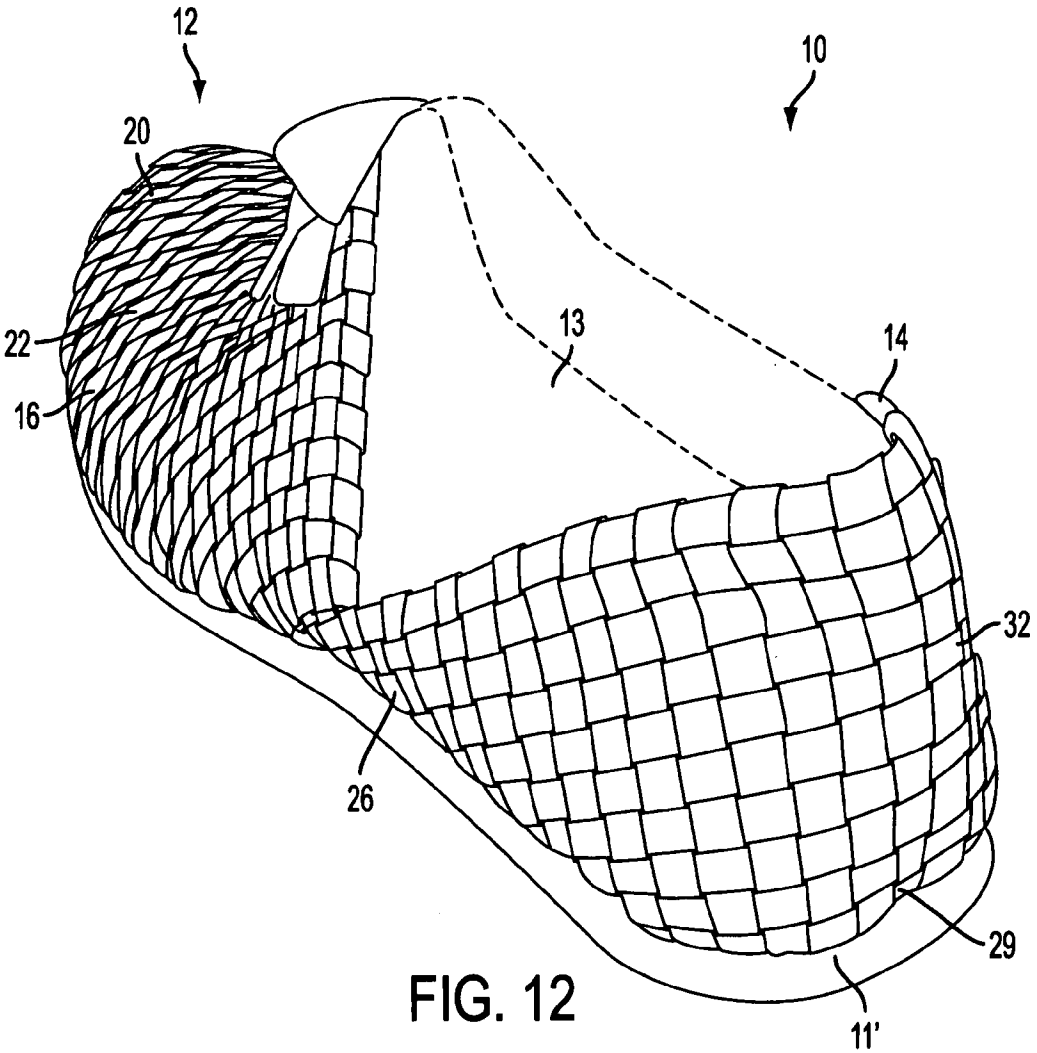
FIG. 12 is a perspective view of the article of footwear shown in FIG. 1 pictured with an alternative bottom/sole unit thereon.
Figure 13:
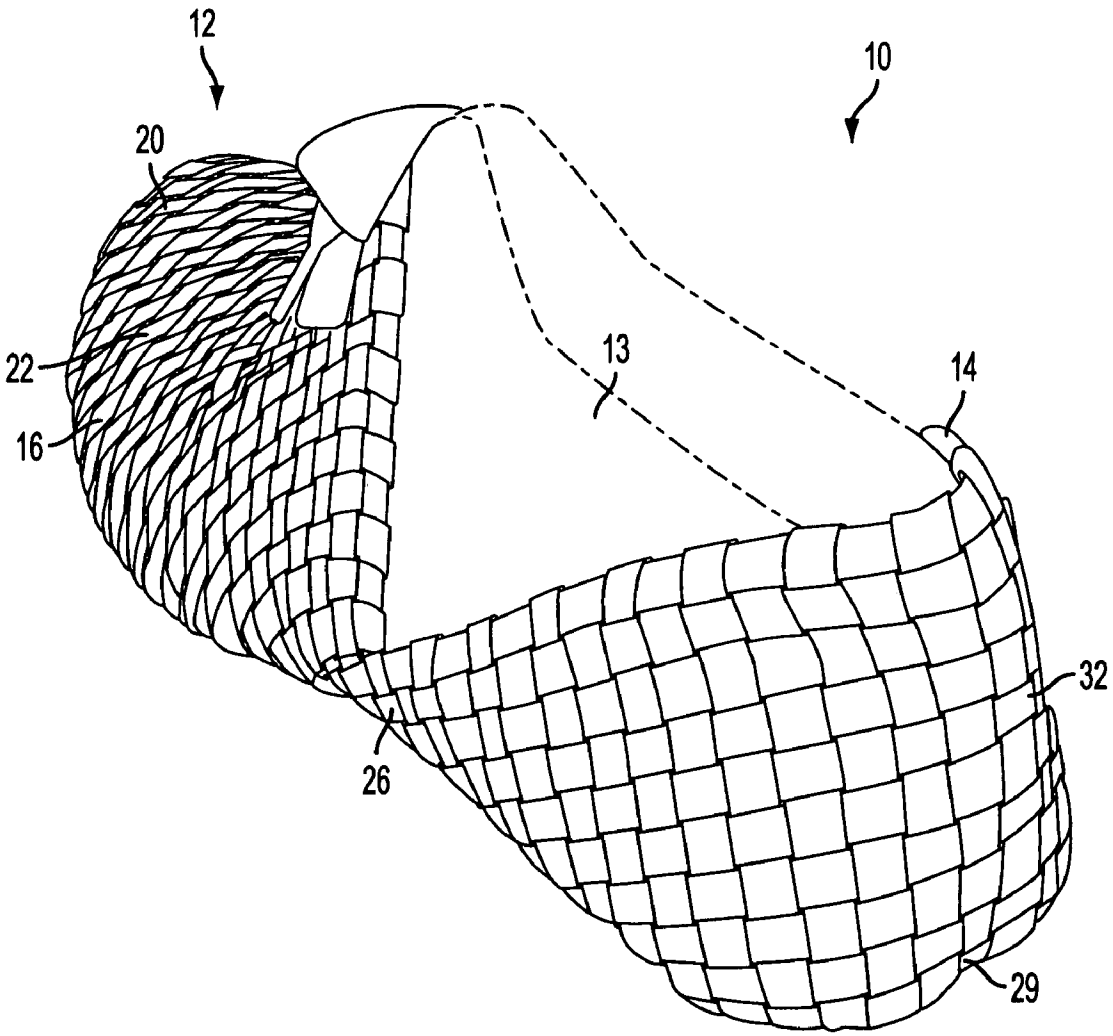
FIG. 13 is a perspective view of the article of footwear shown in FIG. 1 which is void of a sole unit.

The sole 11 may be a full length sole extending from substantially the front to substantially the back of shoe 12. However, in an illustrative embodiment, as shown in FIG. 11, the sole 11 includes separated forefoot and rearfoot components. FIGS. 12-13 illustrate alternate embodiments that do not include conventional athletic shoes (such as for basketball, running, and cross-training purposes). More specifically, FIG. 12 illustrates the shoe 10 which a schematically depicted sole 111' which is formed by one or more thin flexible layers such as foam, suede, and/or leather. The sole 11' need not be continuous and preferably only covers openings in the weave in the rearfoot and forefoot regions. FIG. 13 illustrates the shoe 10 being void of any sole and the bottom of the shoe is formed solely by the weave pattern. For this embodiment, it is recognized that the weave of the woven body 32 would cover or substantially cover the entire bottom of the foot and there would not be open regions as shown in FIG. 4. These embodiments may be desirable or various purposes such as for ballet and dancing activities and for slippers and other casual purposes.

The shoe 10 with the woven upper 12 provides a comfortable and breathable article of footwear for casual use and for use in athletics. The woven upper 12 provides enhanced breathability over solid materials especially as the toes are a region of high sweat generation. Further, the use of a tightening lace strap 82 to form lace holding elements provides an efficient use of elements while the lace strap serves to provide a snug fit for the upper in the arch and heel regions and can provide an enhanced range in motion. Such is beneficial in many athletic sporting activities from track and field to dancing. It should be also be noted that the outsole/midsole can also be woven into the design. For example, in an article of footwear intended for dancing, a piece of thick leather can be substituted for traditional lasting sock materials to create an outsole. Other arrangements permitting an outsole/midsole to be woven into the design are also possible.

Additionally, in the depicted arrangement, the shoe 10 is tongueless. That is, there is no tongue provided. This reduces the number of parts needed to make a comfortable fitting shoe. However, in an alternative embodiment, a tongue is provided and such may be a woven tongue or a solid material such as leather or synthetic.

While the various features of shoe 10 work together to achieve the advantages previously described, it is recognized that individual features and sub-combinations of these features can be used to obtain some of the aforementioned advantages without the necessity to adopt all of these features. The present invention is disclosed above and in the accompanying drawings with reference to a variety of embodiments. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

What is claimed is:

1. An article of footwear comprising:

an upper including a woven area having a weave; and a strap incorporated into the weave of the woven area configured to permit the adjustment of the fit of the upper to a foot of a user, wherein the strap forms a plurality of opposed lace holding elements.

2. The article of footwear of claim 1, wherein the upper is at least 50% formed by the woven area.

3. The article of footwear of claim 1, wherein the upper substantially consists of the woven area.

4. The article of footwear of claim 1, further comprising a shoe lace functionally coupled to the lace holding elements.

5. The article of footwear of claim 4, wherein the strap forms at least four lace holding elements.

6. The article of footwear of claim 5, wherein the lace holding elements are lace loops.

7. The article of footwear of claim 6, wherein the shoe lace is directly routed through the lace loops.

8. The article of footwear of claim 1, wherein the strap is incorporated into and is adjustably movable relative to the woven region.

9. The article of footwear of claim 1, wherein the woven area is formed from multiple webbing elements including at least one partially elastic member.

10. The article of footwear of claim 1, wherein the weave includes at least one elongated strand and the strap is superimposed on at least a portion of the strand.

11. The article of footwear of claim 1, wherein the article of footwear includes a lower portion configured to extend beneath the foot of the user, wherein the strap includes first and second opposing ends that are each attached to the lower portion.

12. An article of footwear comprising:

an upper including a woven area having a weave; and a strap incorporated into the weave of the woven area configured permit the adjustment of the fit of the upper to a foot of a user;

wherein the article of footwear includes a heel region and wherein the strap encircles the heel region at least two times.

13. An article of footwear comprising:

an upper having medial and lateral sides;

a footbed;

a fit adjusting system configured provide an adjustable fit to the upper, the fit adjusting system including a lateral side lace holding element and a medial side lace holding element, the lateral side lace holding element and the medial side lace holding element being formed from a common elongated strand member;

wherein the elongated strand member extends below the footbed;

wherein the fit adjusting system further includes a plurality of lace holding elements disposed on the medial side of the upper and a plurality of lace holding elements disposed on the lateral side of the upper; and wherein the shoe upper includes a woven portion and the elongated strand member is coupled to the woven portion.

14. The article of footwear of claim 13, wherein the shoe upper further includes a heel region and an arch region, and the elongated strand member is coupled to the woven portion of the upper at least four times in each of the arch and heel regions.

15. An article of footwear comprising:

an upper having medial and lateral sides;

a footbed;

a fit adjusting system configured provide an adjustable fit to the upper, the fit adjusting system including a lateral side lace holding element and a medial side lace holding element, the lateral side lace holding element and the medial side lace holding element being formed from a common elongated strand member;

wherein the elongated strand member extends below the footbed;

wherein the elongated strand member extends, in the region between the lateral side lace holding element and said medial side lace holding element, (a) downwardly and rearwardly from the medial lace holding element, (b) across a bottom portion of the article of footwear underneath a footbed from the medial side to the lateral side, (c) around the rear of the heel region from the lateral side to the medial side, (d) across the bottom portion of the article of footwear underneath the footbed from the lateral side to the medial side, and (e) upwardly and forwardly to the lateral lace holding element.

16. The article of footwear of claim 15, wherein the upper is tongueless.

17. An article of footwear comprising:

an upper having medial and lateral sides;

a footbed;

a fit adjusting system configured provide an adjustable fit to the upper, the fit adjusting system including a lateral side lace holding element and a medial side lace holding element, the lateral side lace holding element and the medial side lace holding element being formed from a common elongated strand member;

wherein the elongated strand member extends below the footbed; and wherein the upper includes a heel region and a footbed, said elongated strand member encircles the heel region at least two times, extends below the footbed at least two times, and crosses itself below the footbed.

* * * * *